US005292259A

United States Patent [19]

Sheldrake et al.

[11] Patent Number: 5,292,259

[45] Date of Patent: Mar. 8, 1994

[54] ELECTRICAL CONNECTOR

[75] Inventors: Christopher Sheldrake, Basingstoke; Adam White, London, both of England

[73] Assignee: Nokia Mobile Phones (U.K.) Limited, Surrey, England

[21] Appl. No.: 845,521

[22] Filed: Mar. 4, 1992

Related U.S. Application Data

[63] Continuation of Ser. No. 681,894, Apr. 8, 1991, abandoned.

[30] Foreign Application Priority Data

Apr. 12, 1990 [GB] United Kingdom ..... 9008348

[51] Int. Cl.[5] ..... H01R 13/627

[52] U.S. Cl. ..... 439/353; 439/500; 439/911; 429/97

[58] Field of Search ..... 439/344, 345, 350, 352, 439/353, 299, 500, 911; 429/97, 98, 121, 123, 163

[56] References Cited

U.S. PATENT DOCUMENTS

| | | | |
|---|---|---|---|
| 2,364,787 | 12/1944 | Harrison et al. | 429/98 X |
| 3,639,950 | 2/1972 | Lutz et al. | 439/350 X |
| 3,829,332 | 8/1974 | Iizuka et al. | 429/97 |
| 4,091,246 | 5/1978 | Donofrio et al. | 439/911 X |
| 4,146,291 | 3/1979 | Goff et al. | 439/353 X |
| 4,186,983 | 2/1980 | Kaye | 439/350 |
| 4,387,951 | 6/1983 | Hall et al. | 439/911 X |
| 4,582,381 | 4/1986 | Bisczat et al. | 439/911 X |
| 4,583,803 | 4/1986 | Bringuel | 439/911 X |
| 4,871,325 | 10/1989 | Maejima et al. | 429/353 |
| 4,986,766 | 1/1991 | Leonard et al. | 439/357 X |
| 5,050,211 | 9/1991 | Dortu et al. | 439/911 X |

FOREIGN PATENT DOCUMENTS

| | | | |
|---|---|---|---|
| 55-49433 | 3/1980 | Japan | 439/352 |
| 1244418 | 11/1969 | United Kingdom . | |
| 1257687 | 12/1969 | United Kingdom . | |

*Primary Examiner*—Larry I. Schwartz
*Assistant Examiner*—Khiem Nguyen
*Attorney, Agent, or Firm*—Perman & Green

[57] ABSTRACT

An electrical connector comprises a plug and complementary socket. The plug includes a main body having a portion adapted for insertion into the socket, and a resilient tongue biased away from the main body and extending laterally therefrom generally in the direction of plug insertion. The tongue and the socket are provided with respective catch means which mutually engage when the plug is inserted into the socket. The catch can thus be released simply by squeezing the tongue against the main body. In order to prevent the tongue catching on obstacles and to help prevent inadvertent actuation especially in the context of a portable radio telephone, a rigid joining member is provided between the rearward end of the tongue and the main body.

24 Claims, 1 Drawing Sheet

ELECTRICAL CONNECTOR

This is a continuation of copending application Ser. No. 07/681,894 filed on Apr. 8, 1991, now abandoned.

This invention relates to an electrical connector comprising a plug and complementary socket.

BACKGROUND OF THE INVENTION

Such a connector is known in which the plug comprises a main body having a portion adapted for insertion into the socket, and a resilient tongue biased away from the main body and extending laterally therefrom generally in the direction of plug insertion, and wherein the tongue and the socket are provided with complementary catch means which mutually engage when the plug is inserted into the socket, said catch means being releasable by pressing said tongue towards the main body.

In the known connectors of this type the resilient tongue is fastened to the main body of the plug only at its leading end, i.e. in cantilever fashion, in such manner that the free end of the flying tongue protrudes from the socket when the plug is fully inserted in the socket so that the release mechanism can readily be actuated by the user.

However, the Applicant has found that this form of connector is unsuitable in the context of portable apparatus, such as a portable radio telephone, because there is a tendency for the free end of the protruding tongue to get caught accidentally on various obstacles, for example the user's clothing or furniture. Apart from the inherent disadvantage of getting the connector caught, and possibly even breaking the free end of tongue, the plug may inadvertently become disconnected if the pressure on the tongue is sufficient to release the catch mechanism.

SUMMARY OF THE INVENTION

According to the present invention an electrical connector having the features recited in the preamble of claim 1 below is characterised in that a rigid joining member is provided between the trailing end of the tongue and the main body.

The rigid member between the trailing end of the tongue and the main body of the plug offers the significant advantage that the tongue no longer has a free end and is therefore much less susceptible to being caught on obstacles during use, thus substantially reducing the risk of accidentally releasing the plug from the socket. Furthermore, the resilient joining member acts to hold the otherwise free end of the tongue at a predetermined spacing from the main body of the plug, and helps to bias the tongue away from the main body so that the tongue itself may be formed from an inherently less resilient material.

In a preferred embodiment the main body, the tongue, and the joining member are formed integrally e.g. as a one piece plastics moulding.

BRIEF DESCRIPTION OF THE DRAWINGS

An embodiment of the invention will now be described, by way of example, with reference to the accompanying drawings in which.

DETAILED DESCRIPTION OF THE PREFERRED EMBODIMENT

Figure 1:
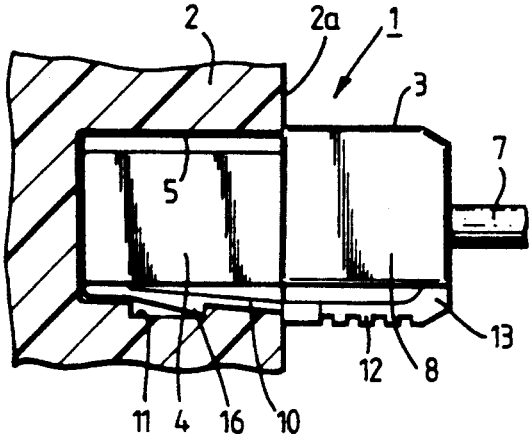
FIG. 1 is a plan view of a connector comprising a plug and part of a socket in accordance with the present invention.

The connector in FIG. 1 comprises a plug 1 and complementary socket 2. In FIG. 1 the plug 1 is shown fully inserted in the socket 2.

The plug comprises a main body 3 having a forward portion 4 having a substantially T-shaped section (see FIG. 2) arranged to fit into a complementary recess 5 in the socket 2. As can be seen from FIG. 2 the transverse limb of the T-shape is asymmetrical in order to ensure that the plug 1 is inserted with the correct orientation into the socket 2. The plug 1 is also provided with a plurality of electrical contacts 6 for engaging complementary contacts (not shown) in the socket 2. In the embodiment illustrated three contacts 6 are shown, but any number of contacts may be employed. As these electrical contacts do not relate directly to the instant invention no further details will be given here, except to say that these terminals are connected within the plug 1 to the respective conductors enclosed within the three-core cable 7 extending from the rear face of the plug.

The rearward part of the main body of the plug 1 comprises a substantially rectangular block-like member 8, larger than the T-shaped portion 4 (See FIGS. 1 and 2), which abuts the wall 2*a* of the socket 2 adjacent the entrance to recess 5 when the plug 1 is fully inserted in the socket 2. The abutting face of member 8 thus acts to limit the extent of insertion of the plug within the socket.

A resilient tongue-like member 10 is joined to the main body 3 of the plug 1 at its forward (leading) end and is generally biased away therefrom. A protruding member in the form of a barb 16 is present on the outward face of tongue 10 towards the forward end thereof. This barb 16 engages in a complementary recess 11 provided in the socket 2 when the plug is fully inserted therein. The barb 16 and recess 11 thus act as a catch mechanism to hold the plug firmly in place when the plug is fully inserted in the socket.

The rearward, wider portion 12 of tongue 10 protrudes outside the socket 2 even when the plug is fully inserted. This rearward portion 12 of the tongue 10 is provided with several parallel ribs and grooves to provide a tactile feature and also to enhance the visual appearance.

Additionally a relatively broad and rigid connecting bar 13 joins the rearmost (trailing) end of the tongue 10 to the rectangular block portion 8 of the main body 3 of the plug 1. In the embodiment implemented by the Applicant the main body 3, the tongue 10 and the joining bar 13 were all formed integrally as a unitary member and moulded from a plastics material.

The plug can be released from the socket 2 simply by squeezing the tongue 10 against the side of the main body 3 of the plug to free the barb 16 from the recess 11. It is noted here that the joining member 13 helps to bias the tongue 10 away from the main body 3 of the plug to promote the locking of the catch mechanism when the plug is inserted in the socket.

Figure 3:
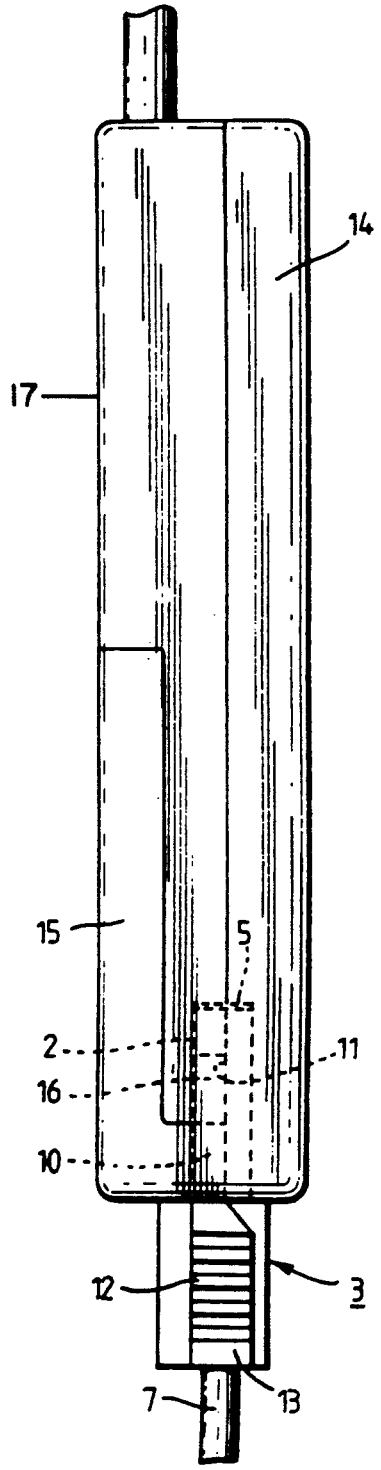
FIG. 3 shows a portable radio telephone comprising a removable battery and incorporating a connector in accordance with the invention.

FIG. 3 illustrates a portable cellular radio telephone 14 having frame or housing 17 with a rechargeable battery 15 removably connected thereto. Ordinarily the battery may be removed by sliding it down away from the telephone 14 in the direction of the longitudinal axis.

Figure 2:
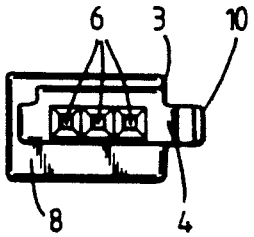
FIG. 2 is an end view showing the electrical contacts of the plug in FIG. 1.

The telephone 14 additionally includes a connector as already described with reference to FIGS. 1 and 2. Hence a socket 2 is provided in the frame or housing 17 at the underside of the telephone adjacent the base of the battery 15. When the plug 1 is inserted into the telephone the rearward block 8 additionally abuts the lower edge of the battery 15. Since the plug 1 is locked in place by the action of the catch mechanism 10, 11 the battery cannot be removed when the plug 1 is connected to the telephone. Of course when the plug has been released by actuating the tongue 10 as described above the battery can readily be removed in the normal manner. The plug may be connected to any suitable electrical accessory, in particular a charging unit for recharging the battery 15.

In view of the foregoing description in will be evident to a person skilled in the art that various modifications may be made within the scope of the present invention. For example, the plug may include more or less than the three electrical contacts disclosed herein. Furthermore, particularly in the case of a larger plug comprising more contacts a similar resilient tongue and joining bar may be provided on two opposite sides of the main body of the plug.

We claim:

1. A portable electronic apparatus and removable electrical cable assembly comprising:

a frame forming at least a portion of a housing of the portable electronic apparatus, the frame having a socket;

a battery removably mounted to the frame; and an electrical plug connector removably mounted at the socket, the connector having the cable connected thereto, the connector comprising:

(a) a main body having a portion adapted for insertion into the socket;

(b) a resilient tongue biased away from the main body and extending laterally therefrom generally in the direction of insertion, wherein the tongue and the socket are provided with complementary catch means which mutually engage when the plug is inserted into the socket, said catch means being releasable by pressing said tongue towards the main body, and wherein a rigid joining member extends between a trailing end of the tongue and the main body;

wherein an abutment on the main body of the plug is adapted to bear against the battery when the plug is fully inserted in the socket whereby removal of the battery is prevented.

2. An assembly as claimed in claim 1 wherein the battery is a rechargeable battery, and the plug of the connector is connected to means for charging said battery.

3. An assembly as claimed in claim 1 wherein the portion of the main body adapted for insertion into the socket has a substantially T-shaped section in the plane transverse to the direction of plug insertion, the socket having a complementary aperture for receiving said T-shaped portion.

4. An assembly claimed in claim 1 wherein the main body comprises an abutment member which bears against the socket when the plug is fully inserted therein.

5. An assembly as claimed in claim 1, wherein the tongue is provided with a plurality of ribs and grooves adjacent said joining member.

6. An assembly as claimed in claim 1, wherein the catch means comprises a protrusion on the tongue and a recess in the socket.

7. An assembly as claimed in claim 1, wherein the rigid joining member is formed integrally with said tongue.

8. A portable electronic apparatus as claimed in claim 7, wherein the rigid joining member and the tongue are formed integrally with the main body.

9. A portable electronic apparatus comprising a frame, a removable member connected to the frame, the removable member comprising a battery, and a plug removably connected to the frame, the frame having a socket located proximate the removable member for removably receiving said plug, the plug including means which prevent the removable member from being removed from the frame when the plug is fully inserted in the socket, the means which prevent the removable member from being removed including a surface of the plug being located in a path of removal of the removable member from the frame.

10. A portable electronic apparatus as claimed in claim 9, wherein the removable member is a rechargeable battery, and the plug is connected to means for charging said battery.

11. A portable electronic apparatus as claimed in claim 9, wherein the plug comprises a portion having a substantially T-shaped section in the plane transverse to the direction of plug insertion, the socket having a complementary aperture for receiving said T-shaped portion.

12. A portable electronic apparatus as claimed in claim 9, wherein the plug and socket include complementary latch means which mutually engage when the plug is inserted in the socket.

13. A portable electronic apparatus as claimed in claim 9, wherein the plug comprises a main body having a portion adapted for insertion into the socket, and a resilient tongue biased away from the main body and extending laterally therefrom generally in the direction of plug insertion, wherein the tongue and socket are provided with complementary catch means which engage when the plug is inserted into the socket, said catch means being releasable by pressing said tongue towards the main body.

14. A portable electronic apparatus as claimed in claim 13, wherein a rigid joining member extends between a trailing end of the tongue and the main body.

15. A portable electronic apparatus comprising a housing, a removable member connected to the housing, the removable member comprising a battery, and a plug, the housing having a socket for removably receiving at least a portion of the plug, the plug being removably attached to the housing at the socket, the plug including abutment means which bear against said removable member to impede the removal thereof from the housing when the plug is fully inserted in the socket.

16. A portable electronic apparatus as claimed in claim 15, further including releasable latch means which hold the plug secure when the plug is fully inserted in the socket.

17. A portable electronic apparatus as claimed in claim 16, wherein the removable member is a rechargeable battery, and the plug is connected to means for charging said battery.

18. A portable electronic apparatus as claimed in claim 15, wherein the plug comprises a portion having a substantially T-shaped section in the plane transverse to the direction of plug insertion, the socket having a complementary aperture for receiving said T-shaped portion.

19. A portable electronic apparatus and removable electrical cable assembly comprising:

a frame forming at least a portion of a housing of the portable electronic apparatus, the frame having a socket;

a battery removably mounted to the frame; and an electrical plug connector removably mounted at the socket, the connector having the cable connected thereto, the connector comprising:

(a) a main body having a portion adapted for insertion into the socket;

(b) a resilient tongue biased away from the main body and extending laterally therefrom generally in the direction of insertion, wherein the tongue and the socket are provided with complementary catch mean which mutually engage when the plug is inserted into the socket, said catch means being releasable by pressing said tongue towards the main body;

wherein an abutment on the main body of the plug is adapted to bear against the battery when the plug is fully inserted in the socket whereby removal of the battery is prevented.

20. A portable electronic apparatus as claimed in claim 19 wherein the battery is a rechargeable battery, and the plug of the connector is connected to means for charging said battery.

21. A portable electronic apparatus as claimed in claim 19 wherein the portion of the main body adapted for insertion into the socket has a substantially T-shaped section in the plane transverse to the direction of plug insertion, the socket having a complementary aperture for receiving said T-shaped portion.

22. A portable electronic as claimed in claim 19 wherein the main body comprises an abutment member which bears against the socket when the plug is fully inserted therein.

23. A portable electronic apparatus as claimed in claim 19, wherein the tongue is provided with a plurality of ribs and grooves.

24. A portable electronic apparatus as claimed in claim 19, wherein the catch means comprises a protrusion on the tongue and a recess in the socket.

* * * * *